United States Patent [19]

Landucci

[11] 4,215,205

[45] Jul. 29, 1980

[54] FLUOROALIPHATIC RADICAL AND CARBODIIMIDE CONTAINING COMPOSITIONS FOR FABRIC TREATMENT

[75] Inventor: Dennis P. Landucci, Lake Elmo Township, Washington County, Minn.

[73] Assignee: Minnesota Mining and Manufacturing Company, St. Paul, Minn.

[21] Appl. No.: 758,586

[22] Filed: Jan. 12, 1977

Related U.S. Application Data

[60] Division of Ser. No. 554,420, Mar. 3, 1975, Pat. No. 4,024,178, which is a division of Ser. No. 380,702, Jul. 19, 1973, Pat. No. 3,896,251, which is a continuation-in-part of Ser. No. 232,186, Mar. 6, 1972, abandoned.

[51] Int. Cl.[2] ..... C08F 8/30

[52] U.S. Cl. ..... 525/331; 560/25; 252/8.7; 428/288; 525/374

[58] Field of Search ..... 525/331, 374

[56] References Cited

U.S. PATENT DOCUMENTS 3,988,502 12/1971 Patel ..... 526/18

OTHER PUBLICATIONS

Chem. Abst., 66, 76542m (1967).

*Primary Examiner*—C. A. Henderson
*Attorney, Agent, or Firm*—Cruzan Alexander; Donald M. Sell; William G. Ewert

[57] ABSTRACT

Durably launderable and dry-cleanable repellency to water and oil is conferred on fabrics consisting essentially completely of hydrophobic synthetic fibers by application of a blend of a fluoroaliphatic vinyl polymer and a carbodiimide, preferably comprising fluoroaliphatic groups.

1 Claim, No Drawings

FLUOROALIPHATIC RADICAL AND CARBODIIMIDE CONTAINING COMPOSITIONS FOR FABRIC TREATMENT

This application is a division of application Ser. No. 554,420 filed Mar. 3, 1975, now U.S. Pat. No. 4,024,178, which is a division of application Ser. No. 380,702, filed July 19, 1973, now U.S. Pat. No. 3,896,251, which is a continuation-in-part of my copending application Ser. No. 232,186, filed Mar. 6, 1972, now abandoned.

This invention relates to textile materials and, in particular, to the class of materials including those known as outerwear fabrics which consist essentially of hydrophobic synthetic fibers. This invention relates more particularly to processes for treating synthetic fiber-containing materials to impart durable water and oil repellency and materials so protected.

As a result of the development of polymers containing fluoroaliphatic radicals, a variety of methods for treating fabrics to provide resistance to aqueous and oily stains has been developed. Depending upon the intended field of use, these treatments have been more or less durable and have conferred varying degrees of resistance to abrasion, laundering, dry cleaning and such other conditions as are encountered by the fabric during its use. In general, each particular type of fabric and each particular use has required a somewhat different treatment, sometimes involving different treating resins, for optimum economic performance.

In particular, excellent durable treatments have been provided for fabrics consisting of blends of synthetic and cellulosic fibers in which the treating materials includes both a fluoroaliphatic radical-containing polymer and an aminoplast resin of the sort typified by the conventional durable-press resins described in U.S. Pat. Nos. 2,783,231 and 2,974,432. Typically, such fabrics have contained from between 25 to 75% of each fiber component. The aminoplast resin deposits primarily upon the cellulosic fibers during treatment and seems to have served to provide improved durability of the fluorochemical treatment toward laundering and dry cleaning.

Recently fabrics consisting substantially completely of hydrophobic synthetic fibers, typically those based on polyamides (e.g., nylon) and polyesters (e.g., polyethyleneglycol terephthalate) have become popular for outerwear, light-weight, brightly colored garments particularly useful in sports wear, such as ski jackets, wind breakers, and the like. Such garments obviously encounter a variety of soils, are worn in the rain and under adverse conditions, and should advantageously display the highest resistance to water as well as to staining and soiling conditions. Such garments also require frequent cleaning, and such cleaning may be either laundering or dry cleaning, depending primarily upon the whims of the user. Heretofore, there has been no satisfactory method for providing such fabrics with the combination of soil and stain resistance with a high level of water repelency which would be durable under the ordinary cleaning procedures. Durable-press resins applied in sufficient concentration to provide durability produce a hand that is harsh and stiff and completely unacceptable to the customer, perhaps because of the lack of hydrophilic fibers in the fabric. Other materials such as upholstery and carpet fabrics may also be made of 100% synthetic fibers.

It is a principal aim and object of this invention to provide durable water and oil repellency for textiles consisting essentially of synthetic fibers. Other aims and objects will become apparent hereinelsewhere.

In accordance with these and other aims and objects of the invention, it has been found that durably launderable and dry-cleanable oil and water repellency can be conferred on fabrics consisting essentially of hydrophobic synthetic fibers by applying to said fabric a blend of a fluoroaliphatic group-containing material and a carbodiimide in proportions of from 10:90 to 95:5 and preferably from 20:80 to 80:20 fluoroaliphatic radical-containing material to carbodiimide. The blend may be applied as a suspension or solution in either aqueous or non-aqueous media.

A preferred fluoroaliphatic radical-containing material is a substantially linear vinyl polymer containing from 10 to 60 percent by weight of the polymer of fluorine in the form of fluoroaliphatic groups terminating in $CF_3$ groups and containing at least three fully fluorinated carbon atoms. Acrylates and methacrylates are readily available and very convenient vinyl polymers and are particularly preferred.

The carbodiimides consist essentially of from 1 to a plurality, preferably not over 20, of carbodiimide groups, terminal organic radicals free from isocyanate-reactive hydrogen atoms connected to carbodiimide and, when two or more carbodiimide groups are present, also polyvalent, preferably divalent, organic linking groups which are residues of a polyisocyanate between successive carbodiimide groups. Fluoroaliphatic groups may form parts of terminal or linking groups.

The treating solution is applied by padding, spraying or other conventional means and the vehicle or solvent is vaporized to leave a coating of the blend on the fibers. The components can be applied in a series of applications or, more conveniently, as a single blend. A blend of vinyl polymer and carbodiimide combined in a ratio of 10:90 to 95:5 may be prepared in the desired aqueous or non-aqueous medium and diluted as needed to form the treating solution. The fabric is found to be oil and water repellent, launderable and dry-cleanable with substantial retention of repellent properties and to possess a pleasant hand.

Any of the art-recognized fluoroaliphatic radical-containing polymers useful for the treatment of fabrics to obtain oil and water-born stain repellency can be used including condensation polymers such as polyesters, polyamides, polyepoxides and the like, and vinyl polymers such as acrylates, methacrylates, polyvinyl ethers and the like. Many of these are disclosed in the reference in Table 1.

The preferred class of fluoroaliphatic radical-containing vinyl polymers is composed of the acrylate and methacrylate polymers and random copolymers. In any event, it is essential that the vinyl polymer contain a fluoroaliphatic radical terminating in a $CF_3$ group and containing at least three fully fluorinated carbon atoms, preferably a perfluoroalkyl group. The polymer may contain as little as 10% of its weight of fluorine in the form of fluoroaliphatic radicals, and as much as 60% for maximum resistance to dry cleaning. It is preferred that the polymer contain from about 15% to 45% by weight of fluorine. The fluoroaliphatic polymer is applied to the treated fabric so as to provide between 0.02 and 0.5% by weight of carbon-bonded fluorine on the fabric, preferably 0.05–0.25% by weight. Although higher levels of fluorine can be applied to provide useful products, the increased cost is not usually warranted by increase in performance.

Table I

| Inventors | U. S. Pat. No. | Title |
|---|---|---|
| Ahlbrecht. Reid and Husted | 2,642,416 | Fluorinated Acrylates and Polymers |
| Ahlbrecht. Brown and Smith | 2,803,615 | Fluorocarbon Acrylate and Methacrylate Esters and Polymers |
| Bovey and Abere | 2,826,564 | Fluorinated Acrylate and Polymers |
| Ahlbrecht and Smith | 3,102,103 | Perfluoroalkyl Acrylate Polymers and Process of Producing a Latex thereof |
| Johnson and Raynolds | 3,256,230 | Polymeric Water and Oil Repellents |
| Johnson and Raynolds | 3,256,231 | Polymeric Water and Oil Repellents |
| Fasick and Raynolds | 3,282,905 | Fluorine Containing Esters and Polymers thereof |
| Smith and Sherman | 3,329,661 | Compositions and Treated Articles thereof |
| Smith and Sherman | 3,356,628 | Copolymers of Perfluoro Acrylates and Hydroxy Alkyl Acrylates |
| Farah and Gilbert | 3,407,183 | Acrylate and Methacrylate Esters and Polymers thereof |
| Kleiner | 3,412,179 | Polymers of Acrylyl Perfluorohydroxamates |
| Sweeny and Liauw | 3,420,697 | Perfluoroalky-substituted Polyamide Oil-repellency Compound and Textile Materials Treated therewith |
| Pacini | 3,445,491 | Perfluoroalkylamido-alkylthio Methacrylates and Acrylates and Intermediates therefor |
| Eygen and Carpentier | 3,470,124 | New Fluorinated Compounds and Their Preparation |
| Brace | 3,544,537 | Poly(perfluoroalkoxy)-polyfluoroalkylacrylate-type Esters and Their Polymers |
| Tandy | 3,546,187 | Oil and Water Repellent Polymeric Compositions |

Carbodiimides are conveniently obtained by condensation of isocyanates in the presence of suitable catalysts as described, for example, in the patents of Table 2 and by Campbell et al., J. Org. Chem., Vol. 28, pages 2069–2075 (1963).

Table 2

| Inventor | U.S. Pat. No. | Title |
|---|---|---|
| Balon | 2,853,518 | Chemical Process |
| Campbell and Verbanc | 2,853,473 | Production of Carbodiimides |
| Campbell | 2,941,966 | Carbodiimide Polymers |
| Smeltz | 2,941,983 | Urethane-Terminated Polycarbodiimides |

Table 2-continued

| Inventor | U.S. Pat. No. | Title |
|---|---|---|
| Hoeschele | 3,450,562 | Cellulosic Materials Coated with An Organic Polycarbodiimide |
| British Patent | 1,224,635 | Stabilized Polyester Shaped Articles |

The carbodiimides employed in the invention can be of more or less conventional types including terminal hydrocarbon radicals or they may include fluoroaliphatic radicals as noted above. Fluoroaliphatic radical-containing carbodiimides were not known heretofore and are particularly useful in fabric treatments. The carbon-bonded fluorine of these polymers which ranges from about 15 to about 45 percent is included within the totals of fluorine applied to the fabric, i.e., 0.02 to 0.5% by weight.

In general, carbodiimides formed from di-isocyanates with or without monoisocyanates are represented for convenience by the general formula:

$$B\text{-}(N{=}C{=}N\text{-}A)_n N{=}C{=}N\text{-}B$$

where n is 0 or an integer from 1 to at least 20 and preferably from 1 to 10. A and B are as defined below. The A groups or B groups may each be the same or different. Carbodiimides in which n is 20 and higher are useful but offer no known advantages.

In the above general formula, A is a divalent organic group which may include pendent fluoroaliphatic radicals linking successive carbodiimide groups when n is 1 or more. Illustrative linking groups include alkylene, such as ethylene, isobutylene, and the like of 2 to about 10 carbon atoms, aralkylene, such as $—CH_2C_6H_4CH_2—$, of up to 10 carbon atoms, arylene, such as tolylene, $—C_6H_3(CH_3)—$, of up to about 10 carbon atoms, polyoxaalkylene such as $—(C_2H_4O)_xC_2H_4—$, containing up to about 5 oxa groups and combinations of the various types. It will be recognized that the A group is the residue of an organic diisocyanate, that is, the divalent radical obtained by removal of the isocyanate group from an organic diisocyanate. Suitable organic diisocyanates may be simple, e.g., toluene diisocyanate, or complex, as formed by the reaction of a simple diisocyanate with a di- or polyol in proportions to give an isocyanate terminated polyurethane.

Although carbodiimides generally and preferably include divalent A groups, some of the A groups can be, for example trivalent or tetravalent derived from triisocyanates or tetraisocyanates such as polymethylenepolyphenyl isocyanates, e.g., $OCNC_6H_4CH_2C_6H_3(NCO)CH_2C_6H_4NCO$. When A is trivalent or tetravalent, branched or even cross-linked polycarbodiimides result. A mixture of A groups containing some trivalent groups can be used to provide branched polycarbodiimides which retain the desirable solubility and thermoplasticity of the linear carbodiimides resulting from carbodiimides having divalent A groups.

The carbodiimide groups (—N=C=N—) should represent at least 12% of the molecule except for terminal and pendent fluoroaliphatic radicals present.

Substituents may be present in A groups provided they contain no isocyanate-reactive hydrogen atoms; that is, groups such as —OH are normally excluded. Simple unsubstituted organic linking groups free from non-aromatic unsaturation are preferred. The organic linking group depends on the polyisocyanate compound employed such as:

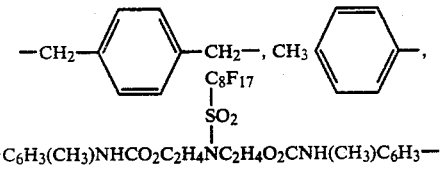

$$-C_6H_3(CH_3)NHCO_2C_2H_4NC_2H_4O_2CNH(CH_3)C_6H_3-$$

The terminal groups, or B-groups, are preferably monovalent radicals of monoisocyanate compounds which may be aliphatic as $C_4H_9$—, aralkyl as $C_6H_5CH_2$—, aryl as $C_6H_5$—, and preferably fluoroaliphatic such as $C_4F_9C_2H_4$—, and $C_7F_{15}CH_2O_2CNHC_6H_4(CH_3)$—, (derived from tolylene diisocyanate and 1,1-dihydroperfluorooctanol). Numerous other terminal groups are operable in the compounds and process of the invention. When only diisocyanates are used to form the polycarbodiimides, the B groups are monovalent radicals derived from diisocyanates and include an isocyanate group (or an hydrolysis product of such a group). The terminal B groups may be the same or different.

Because of the monoisocyanate terminates the carbodiimide molecule, the relative proportion of monoisocyanate to diisocyanate used in the reaction determines the average value of n in the above formula, 0 when no diisocyanate is used upwards so that with about 10 mole percent of monoisocyanate and 90 percent of diisocyanate n will average about 20 as will be readily apparent.

The invention is more particularly described hereinbelow by examples of the preparation of suitable components for the process of the invention and by examples showing the effectiveness of the process of the invention in providing oil and water repellency durable to washing and/or drycleaning. In these examples, all parts are by weight. The testing procedures employed in these examples are as follows:

Synthetic fabrics of 100% filament nylon and 100% spun and 100% filament polyester are treated with the blended formulation at a predetermined level of fluoroaliphatic component on the fabric. This level is conveniently set to give a particular weight of carbon-bonded fluorine on the fabric, usually of the order of 0.05 to about 0.5% by weight.

The water repellency of the tested fabrics is measured by Standard Test Number 22-52, published in the 1952 Technical Manual and Yearbook of the American Association of Textile Chemists and Colorists, Vol. 28, page 136. The spray rating is expressed on a 0 to 100 scale where 100 is the highest possible rating. For outerwear fabrics particularly, a spray rating of 70 or higher is considered desirable.

The oil repellency test American Association of Textile Chemists and Colorists Standard Test 118–196 is based on the resistance to penetration of oils of varying viscosities. Treated fabrics resistant only to Nujol, a common type of mineral oil, and the least penetrating of the test oils, are given a rating of 1, whereas fabrics resistant to heptane, the most penetrating of the test oils, are given a value of 8. Other intermediate values are determined by use of other pure substances. The oil repellency corresponds to the oil which does not penetrate or wet the fabric after 3 minutes contact. Higher numbers indicate better oil repellency. In general, an oil repellency of 3 or greater is desirable.

The laundering cycle employed is as follows: The treated fabrics are laundered in a mechanically agitated automatic washing machine capable of containing a 4 kg. load, using water at 60° C. and a commercial detergent and then tumble-dried in an automatic dryer for 20 minutes at 88° C. before being tested. They are not ironed after drying.

Drycleaning is performed by a commercial drycleaning establishment and the fabrics are not pressed or heated after the drycleaning process. Perchloroethylene ($C_2Cl_4$) is the solvent used for the drycleaning procedure.

Carbodiimides are usually made from diisocyanates and monoisocyanates in an inert solvent such as methyl isobutyl ketone, conveniently at a concentration of about 40% of dissolved materials, to which is added about 1% of the weight of the materials of a phospholine oxide or other suitable catalyst. The reaction mixture is prepared so that any water is removed before addition of isocyanates and is heated until reaction is essentially complete. The reaction mixture can be emulsified in water and further diluted with water before application. The fabric treating solution can be prepared by blending emulsions of carbodiimide and fluoroaliphatic radical-containing polymers, together with any desired compatible adjuvents. Alternatively, the polycarbodiimide and fluoroaliphatic radical containing polymer can be prepared in solution and the solution blended, diluted if necessary and applied, for example, to fabrics that would be undesirably affected by water. The proportions depend on the amount needed to give a treating solution which will provide the correct concentration of solids, carbodiimides plus fluoroaliphatic-radical containing polymer, to attain the desired weight of treatment at the level of wet pickup chosen. This level is herein set at 50% where not otherwise denominated to give comparability of results. Thus for 50% wet pickup, a 0.3% concentration provides 0.15% solids pickup which at 50% fluorine content gives 0.075% fluorine on the fabric. The latter fluorine content is used in these examples, unless otherwise indicated, to permit ready comparisons.

EXAMPLE 1

A solution of 101.6 parts (0.17 mol) of $C_8F_{17}SO_2N(CH_2CH_2OH)_2$ in 265 parts of methyl isobutyl ketone (MIBK) is first dried by distilling 30 parts of the solvent. Then 54 parts (0.31 mol) of 2,4-toluene diisocyanate are added and the solution refluxed for 2 hours to form a prepolymer diisocyanate. The solution is then cooled to 65°–75° C., and 1 part of 3-methyl-1-phenyl-3-phospholine-1-oxide is added followed by 3 hours further refluxing. A film cast from this solution is weak and brittle and contains the characteristic carbodiimide infrared absorption peak at 4.69 microns. The solution contains the carbodiimide designated Polymer A which is predominantly represented by the formula:

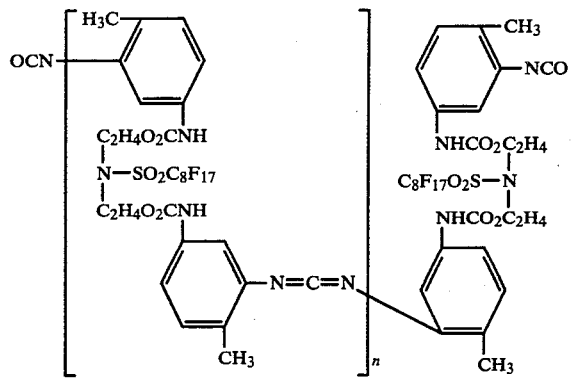

It will be seen that this structure corresponds to the general formula above in which the group designated as "A" is:

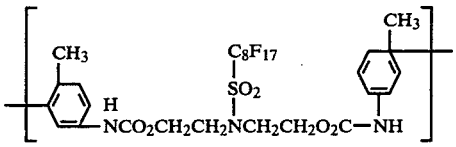

and the "B" group is —A—NCO.

To 100 parts of this polycarbodiimide in 121 parts of MIBK is added 4 parts of polyoxyethylene sorbitan monooleate emulsifier, 4 parts of $C_8F_{17}SO_2N(CH_3)C_2H_4N(CH_3)_3Cl$ emulsifier and 225 parts of distilled water. The mixture is then emulsified using a high shear mixer. The emulsion is employed in fabric treatments.

EXAMPLE 2

A solution of 90 parts (0.15 mol) of $C_8F_{17}SO_2N(C_2H_5)CH_2CH_2OH$ in 320 parts of methyl isobutyl ketone is first dried by distilling and discarding 24 parts of the solvent and 82.4 parts (0.473 mol) of 2,4-toluene diisocyanate are added and the solution is refluxed for 3 hours. After cooling the solution to 65°–75° C., and adding 1.8 parts of 3-methyl-1-phenyl-3-phospholine-1-oxide to it, the solution is refluxed for a further 3 hours. A film cast from this solution is weak and brittle and contains the characteristic carbodiimide absorption peak at 4.79 microns. The solution contains the carbodiimide designated as Polymer B which is represented by the formula:

in which it will be seen that the "A" group is $—C_6H_3C_6H_3—$ and the "B" group is $C_8F_{17}SO_2N(C_2H_5)—C_2H_4O_2CNHC_6H_3(CH_3)—$. To 100 parts of this polycarbodiimide in 138 parts of methyl isobutyl ketone is added 2.5 parts of polyoxyethylene sorbitan monooleate emulsifier (available under the Trademark Tween 80), 2.5 parts of $C_8F_{17}SO_2N(CH_3)C_2H_4N(CH_3)_3Cl$ and 265 parts of distilled water. The mixture is then emulsified.

EXAMPLE 3

To a solution of 27 parts of $$C_8F_{17}SO_2N(CH_3)C_2H_4O_2CC(CH_3)=CH_2,$$

2.85 parts of ethylhexyl methacrylate and 0.15 parts of glycidyl methacrylate in 12 parts of acetone and 48 parts of water are added 1.5 parts of polyethoxylated quaternary ammonium chloride emulsifier, 0.05 parts t-dodecyl mercaptan and 0.05 parts of potassium persulfate. The mixture is degassed, blanketed under nitrogen and then heated to 65° C., and the polymerization allowed to proceed with agitation for 16 hours. A film cast from this material is hard and brittle. The random copolymer having pendent fluoroaliphatic groups is designated Polymer C.

EXAMPLE 4

The procedure of Example 2 is repeated using $C_8F_{17}SO_2N(CH_3)C_2H_4OH$ and a lower amount (27.5 parts; 0.16 mol) of tolylene diisocyanate. The resultant carbodiimide designated Polymer D is represented by the structure:

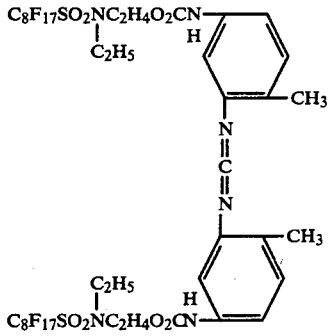

A further series of fluoroaliphatic carbodiimides is prepared by the above procedures using the materials and molar proportions indicated in Table III and designated as shown there.

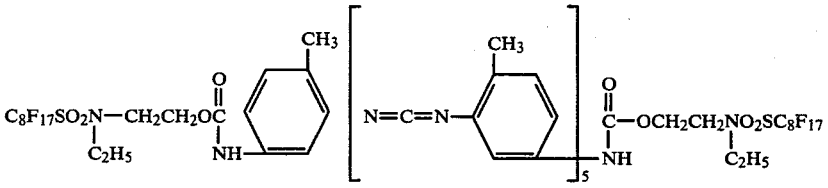

Table III

| Example | Polymer Designation | Reactants |
|---|---|---|
| 5 | E | $C_8F_{17}SO_2N(C_2H_5)—C_2H_4OH$ + 3 mol $(OCN—C_6H_4)_2CH_2$ |

Table III-continued

| Example | Polymer Designation | Reactants |
|---|---|---|
| 6 | F | $C_8F_{17}SO_2N(C_2H_5)-C_2H_4OH$ + 3 mol 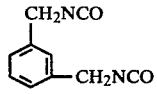 |
| 7 | G | $C_8F_{17}SO_2N(C_2H_5)-C_2H_4OH$ + 5 mol 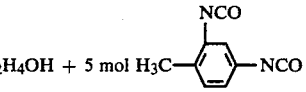 |
| 8 | H MW~2000 | $C_8F_{17}SO_2N(C_2H_5)-C_2H_4OH + HOC_2H_4OH$ + 2 mol 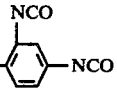 |
| 9 | I MW~5500 | $C_8F_{17}SO_2N(C_2H_5)-C_2H_4OH + C_8F_{17}SO_2N(C_2H_4OH)_2$ + 10 mol 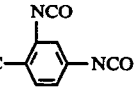 |

A series of non-fluorinated carbodiimides is prepared using the same general procedures as above on the mol proportions of reactants shown in Table IV.

Table IV

| Example | Polymer Designation | Reactants |
|---|---|---|
| 10 | M | Stearyl alcohol + 1 mol 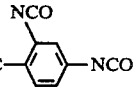 |
| 11 | N | Butanediol + 2 mols 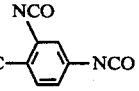 |
| 12 | O MW~1000 | Phenyl isocyanate + 2 mols 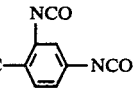 |
| 13 | P | Stearyl alcohol + 3 mols 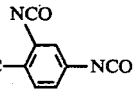 |
| 14 | Q MW~5000 | Stearyl alcohol + 5 mol 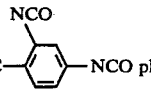 NCO plus 2 mol OH -terminated polydiethylene glycol polyester of adipic acid |

For purposes of providing fluoroaliphatic polymers, a number of materials are prepared or obtained commercially. These also are designated by letters.

Polymer U designates a commercially available material believed to be a 50/50 blend of poly(2-ethylhexyl methacrylate) and poly(1,1,2,2-tetrahydroperfluoroalkyl methacrylate) in which the alkyl group has an average composition of about 10 carbon atoms. This is available under the Trademark Zepel D.

Polymer V designates a 50/50 blend of two polymers. One is made by emulsion polymerizing for 16 hours at 50° C. a mixture of 50 parts methyl methacrylate and 60 parts of tridecyl acrylate in 126 parts of water and 54 parts of acetone in the presence of 2 parts of $C_8F_{17}SO_2N(CH_3)C_2H_4N(CH_3)_2HCl$ as emulsifier and 3 parts of a commercial polyoxyethylene lauryl ether as another emulsifier and using 0.2 parts of potassium persulfate as catalyst. The other polymer is prepared, using the same amounts of emulsifier and catalyst and same reaction conditions, from 93.5 parts of $C_8F_{17}SO_2N(C_2H_5)C_2H_4OCOC(CH_3)=CH_2$, and 6.5 parts of isoprene in 144 parts of water and 36 parts of acetone with the addition of 0.75 parts of t-dodecyl mercaptan.

Polymer W is like the latter polymer used in Polymer V, but prepared from equal amounts of $C_8F_{17}SO_2-N(C_2H_5)C_2H_4OCOC(CH_3)=CH_2$ and chloroprene as described in Example III D of U.S. Pat. No. 3,068,187.

Polymer X is prepared as in the above procedures, heating a reaction mixture of 90 parts $C_8F_{17}SO_2N(CH_3)C_2H_4-OCOC(CH_3)=CH_2$, and 10 parts butylacrylate in 160 parts water and 40 parts acetone with 0.2 parts t-dodecyl mercaptan and 0.2 parts potassium persulfate using 5 parts of a commercial polyethoxylated quaternary ammonium chloride emulsifier at 65° C. for 16 hours.

As noted hereinabove, fabrics of 100% filament nylon and both 100% spun and 100% filament polyester are treated by standard procedures with various blends of fluoroaliphatic vinyl polymers and carbodiimides and rated for oil and water repellency after treatment and again after 5 launderings and in some cases also after 5 drycleanings. The data are presented in the following tables in which Nylon = 100% filament nylon
Polyester F = 100% filament polyester
Polyester S = 100% spun polyester Initial=data before laundering etc.
Laundered=data after 5 launderings Drycleaned=data after 5 drycleanings.

Except as noted, the fabrics are treated to contain 0.075% carbon bonded fluorine. Proportions of polymers blended together are indicated as, e.g., 65C+35B, and for controls or comparisons where there is no blend, as e.g., 100C. The ratings are given for conciseness as a fraction, e.g., 5/100, in which the numerator (5) is oil rating and denominator (100) is spray rating.

Table V

| Treatment | Polymer Blend | Initial | | | Laundered | | |
|---|---|---|---|---|---|---|---|
| | | Nylon | Polyester S | Polyester F | Nylon | Polyester S | Polyester F |
| 1 | 65C + 35B | 2/100 | 5/95 | 6/100 | 2/95 | 4/95 | 5/95 |
| 2 | 50C + 50D* | 5/100 | 6/95 | 5/90 | 4.5/90 | 6/100 | 4.5/85 |
| 3 | 65C + 35A* | 1/100 | 6/100 | 5/100 | 1/100 | 3.5/100 | 4.5/100 |
| 4 | 65X + 35A* | 2/100 | 6/100 | 4/100 | 3/85 | 3/95 | 4/85 |
| 5 | 65C + 35E | 5/100 | 5.5/100 | 5.5/100 | 4/100 | 3.5/80 | 4/90 |
| 6 | 65C + 35F | 5.5/100 | 5.5/100 | 5.5/100 | 3/90 | 2.5/75 | 5/80 |
| 7 | 65C + 35G | 1.5/100 | 4/80 | 5/100 | 2/95 | 4.5/80 | 4.5/95 |
| 8 | 50C + 50H | 5/100 | 6/85 | 5.5/100 | 3/90 | 5/85 | 4.5/95 |
| 9 | 65C + 351 | 2/100 | 5/100 | 5/100 | 1/100 | 5/95 | 4/95 |
| 10 | 100C | 2.5/100 | 5/100 | 5/95 | 1.5/75 | 2.5/50 | 2/50 |
| 11 | 100C* | 5/95 | 6/80 | 5.5/100 | 0/00 | 2/70 | 2/60 |

*applied at 0.089% carbon-bonded fluorine on fabric.

Certain of the above were also subjected to drycleaning with the results shown in Table VI.

Table VI

| Treatment | Polymer Blend | Initial | | | Drycleaned | | |
|---|---|---|---|---|---|---|---|
| | | Nylon | Polyester S | Polyester F | Nylon | Polyester S | Polyester F |
| 3 | 65C + 35A* | 1/100 | 6/100 | 5/100 | 2/75 | 2.5/70 | 5/70 |
| 4 | 65X + 35A* | 2/100 | 6/100 | 4/100 | 3/70 | 3/70 | 4.5/70 |
| 11 | 100C* | 5/95 | 68 6/80 | 5.5/100 | 5/50 | 0/0 | 3/50 |

*applied at 0.089% carbon-bonded fluorine solids on fabric.

Various fluoroaliphatic vinyl polymers are used with the same fluoroaliphatic carbodiimide and the data tabulated in Table VII.

Table VII

| Treatment | Polymer Blend | Initial | | | Laundered | | |
|---|---|---|---|---|---|---|---|
| | | Nylon | Polyester S | Polyester F | Nylon | Polyester S | Polyester F |
| 12 | 65U + 35B | 6/100 | 6/85 | 5/100 | 4/90 | 4/70 | 2/75 |
| 13 | 65V + 35B | 6/95 | 5/85 | 5/85 | 5/95 | 4/75 | 3/80 |
| 14 | 65W + 35B | 5/95 | 5/80 | 5/95 | 4.5/95 | 4.5/80 | 4/85 |
| 15 | 65C + 35B | 5/100 | 5/100 | 6/100 | 4.5/100 | 5/80 | 3.5/95 |
| 16 | 100 U | 7/95 | 6/70 | 0/60 | 0/50 | 0/50 | 0/50 |
| 17 | 100V | 5/100 | 5/85 | 1/80 | 3/50 | 3/50 | 3/50 |
| 18 | 100W | 5/100 | 5/100 | 5/100 | 5/90 | 5/80 | 3/85 |
| 19 | 100B | 2/70 | 4/85 | 2/70 | 0/70 | 1/80 | 0/7 |

Non-fluorinated carbodiimide blends are compared in the data of Table VIII.

Table VIII

| Treatment | Polymer Blend | Initial | | | Laundered | | |
|---|---|---|---|---|---|---|---|
| | | Nylon | Polyester S | Polyester F | Nylon | Polyester S | Polyester F |
| 20 | 65C + 35M | — | 3/95 | 5/100 | — | 3/85 | 3/85 |
| 21 | 65C + 35N | 5/95 | 6/100 | 5/100 | 2/75 | 5/85 | 4/80 |
| 22 | 65C + 350 | 2/100 | 4/100 | 5/100 | 2/85 | 1/80 | 2/85 |
| 23 | 65C + 35P | — | 4/100 | 5/100 | — | 1/85 | 285 |
| 24 | 65C + 35Q | 2/100 | 5/90 | 5.5/100 | 1/80 | 2/60 | 2/75 |

A further series of fluoroaliphatic radical-containing carbodiimides is also prepared by the above procedures and characterized by melting ranges and fluorine analyses. Infrared absorption spectroscopy confirms the presence of —N=C=N— groups. These carbodiimides are also useful in the fabric treatments as set forth above. Analogous polymeric carbodiimides in which the fluoroaliphatic groups contain from four through 18 fully fluorinated carbon atoms, such as $C_4F_9$—, $C_2F_5C_6F_{10}$—, $C_3F_9O(C_3F_6O)_4CF(CF_3)$—, are also found to be useful. The data on this series of carbodiimides are summarized in Table IX.

Table IX

| Example | Reactants | | Carbodiimide Melting Range | Fluorine % |
|---|---|---|---|---|
| 15 | $2C_8F_{17}SO_2N(CH_3)C_2H_4OH + 2CH_3C_6H_3(NCO)_2$ | (80% 2,4 + 20% 2,6) | 86–130 | 37.1 |

Table IX-continued

| Example | Reactants | | Carbodiimide Melting Range | Fluorine % |
|---|---|---|---|---|
| 16 | $2C_8F_{17}SO_2\overset{\overset{CH_3}{\vert}}{N}C_2H_4OH + 2CH_3C_6H_3(NCO)_2$ | (2,4) | 85–155 | 40.5 |
| 17 | $2C_8F_{17}SO_2\overset{\overset{CH_3}{\vert}}{N}C_2H_4OH + 4CH_3C_6H_3(NCO)_2$ | (2,4) | 90–160 | 34.3 |
| 18 | $2C_8F_{17}SO_2\overset{\overset{CH_3}{\vert}}{N}C_2H_4OH + 6CH_3C_6H_3(NCO)_2$ | (2,4) | 106–174 | 28.8 |
| 19 | $1C_8F_{17}SO_2\overset{\overset{CH_3}{\vert}}{N}C_2H_4OH + 2CH_3C_6H_3(NCO)_2$ $1C_2H_5(OC_2H_4)_3OH$ | (2,4) | 42–75 | 18.5 |
| 20 | $1C_8F_{17}SO_2\overset{\overset{CH_3}{\vert}}{N}C_2H_4OH + 2CH_3C_6H_3(NCO)_2$ 1 resorcinol | (2,4) | 94–170 | 34.5 |
| 21 | $2C_8F_{17}SO_2\overset{\overset{C_2H_5}{\vert}}{N}C_2H_4OH + 2CH_3C_6H_3(NCO)_2$ | (2,4) | 70–9 | 42.5 |
| 22 | $2C_8F_{17}SO_2\overset{\overset{C_4H_9}{\vert}}{N}C_2H_4OH + 2CH_3C_6H_3(NCO)_2$ | (2,4) | 45–60 | 41.0 |
| 23 | $2C_8F_{17}SO_2\overset{\overset{C_4H_9}{\vert}}{N}C_2H_4OH + 2CH_3C_6H_3(NCO)_2$ | (80% 2,4 + 20% 2,6) | 55–70 | 42.3 |

EXAMPLE 24

To a 25 gallon glass-lined kettle equipped with agitator, condenser, and provision for heating and cooling, are added 58 parts of $C_8F_{17}SO_2N(C_2H_5)C_4H_8OH$ and 135 parts of MIBK solvent. The solution is heated to about 115° C. and 25 parts of solvent removed by distillation to ensure anhydrous conditions. The kettle is cooled to about 90° C., 52 parts of 2,4-toluene diisocyanate added and the solution heated to 115° C. for a further 3 hours. The solution is next cooled to 50° C. and 5 parts of a 20% by weight solution of 2,2,3,4,4-pentamethyl-1-phenylphosphetane oxide in methylene chloride added, and the solution is then again slowly heated to 115° C., care being taken to avoid excessive foaming. The solution is maintained at 115° C., with agitation for about 3 hours, or until the isocyanate groups are essentially completely reacted as indicated by the infra-red absorption spectrum. The product is a 40% by weight solution of:

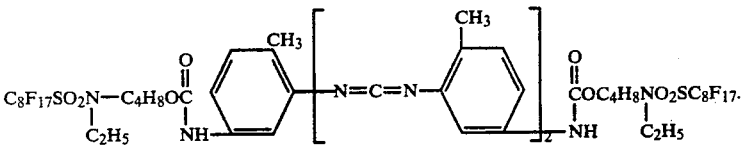

A fabric-treating concentrate is prepared by dissolving 90 parts of a fluoroaliphatic radical-containing methacrylate copolymer (35% fluorine in the form of fluoroaliphatic radicals) in 115 parts of MIBK and 260 parts of $C_2F_3Cl_3$, and adding 25 parts of the above polycarbodiimide product solution.

For treatment of fabrics whose structure would be damaged by exposure to water, such as textured or velvet upholstry fabrics, a solvent system is preferred. For treatment of a medium-weight 100 percent nylon velvet, for example, the above concentrate, is diluted to about 0.4% solids with trichloroethylene. Improved water resistance can be obtained by the addition of a fluorine-free water repellant, such as 0.1% by weight of the solution of a stearato-chrome complex. The fabric is sprayed in a ventilated spray booth with the dilute solution to about 50% wet pick up, then dried in a circulating air oven at 110° C. for about 3 minutes, until the solvent has evaporated and the fabric has reached oven temperature. The resulting treated fabric has an oil rating of 6 and a spray rating of 75. The stain resistance remains even after extensive abrasion.

EXAMPLE 25

A branched polycarbodiimide is prepared by adding to 57.5 parts of dry MIBK (Methyl Isobutyl Ketone)

$C_8F_{17}SO_2N(C_2H_5)C_2H_4OH$—28.6 parts 2,4-Toluene diisocyanate—7.8 parts $OCNC_6H_4CH_2C_6H_3(NCO)CH_2C_6H_4NCO$—2.1 parts The solution is refluxed for 3 hours, then cooled to 90° C. and 1.7 parts of a 22% by weight solution of pentamethyl-1-phenylphosphetane oxide added. The resulting solution is heated to reflux and maintained there for two hours. A further 0.86 parts of catalyst solution is added because the presence of unreacted —NCO is shown by infrared absorption and refluxing is continued for an additional hour. The resulting clear solution is free from —NCO, but exhibits the characteristic absorption peak of carbodiimide at 4.69 microns. Emulsions and solutions containing this polycarbodiimide product and a fluoroaliphatic group containing acrylate copolymer confer durable oil and water resistance on treated fabrics.

What is claimed is:

1. A blend in volatile aqueous or non-aqueous medium of a total of at least 0.3% by weight of (A) fluoroaliphatic radical-containing substantially linear vinyl polymer containing from 10 to 60 percent by weight thereof of fluorine in the form of fluoroaliphatic radicals terminating in $CF_3$ radicals, said fluoroaliphatic radicals containing at least three fully fluorinated carbon atoms, and (B) a carbodiimide consisting essentially of from 1 to a plurality of carbodiimide groups, terminal organic radicals free from isocyanate-reactive hydrogen atoms connected to carbodiimide and, when two or more carbodiimide groups are present, polyvalent organic linking groups, which are residues of polyisocyanates, between successive carbodiimide groups;

the ratio A to B respectively being from about 10:90 to 95:5.

* * * * *

UNITED STATES PATENT AND TRADEMARK OFFICE

CERTIFICATE OF CORRECTION

PATENT NO. : 4,215,205

DATED : July 29, 1980

INVENTOR(S) : DENNIS P. LANDUCCI

It is certified that error appears in the above—identified patent and that said Letters Patent is hereby corrected as shown below:

Column 11, Table VI, line 5, under the first occurrence of the heading "Polyester S", "68 6/80" should read "6/80".

Column 12, Table VIII, line 6, under the second occurrence of the heading "Polyester F", "285" should read "2/85".

Signed and Sealed this

*Sixth* Day of *January 1981*

[SEAL]

*Attest:*

SIDNEY A. DIAMOND

*Attesting Officer*

*Commissioner of Patents and Trademarks*